United States Patent [19]

Searle

[11] Patent Number: 5,049,038

[45] Date of Patent: Sep. 17, 1991

[54] FLUID COMPRESSORS

[75] Inventor: Robin H. J. Searle, Somerset, England

[73] Assignee: Normalair-Garrett (Holdings) Ltd., Yeovil, England

[21] Appl. No.: 595,361

[22] Filed: Oct. 10, 1990

[30] Foreign Application Priority Data

Oct. 21, 1989 [GB] United Kingdom ..... 8923739

[51] Int. Cl.[5] ..... F04B 3/00

[52] U.S. Cl. ..... 417/246; 417/347; 91/291; 91/304; 91/308

[58] Field of Search ..... 417/339, 344, 347, 265, 417/254, 246, 403, 404, 395; 91/291, 304, 308, 315; 251/62

[56] References Cited

U.S. PATENT DOCUMENTS

| | | | |
|---|---|---|---|
| 2,579,670 | 3/1949 | Hjärpe | 91/291 |
| 3,516,763 | 6/1970 | Manton | 417/403 |
| 4,003,679 | 1/1977 | McManigill | 417/246 |
| 4,854,832 | 8/1989 | Gardner et al. | 417/395 |

*Primary Examiner*—Leonard E. Smith
*Assistant Examiner*—Charles Freay
*Attorney, Agent, or Firm*—Larson & Taylor

[57] ABSTRACT

A two stage fluid compressor is operated by a pneumatically operated relay valve controlled by a fluidic switching device in which switching pulses of pressurized control air are obtained automatically on movement of a compression piston in one of the compression stages.

5 Claims, 3 Drawing Sheets

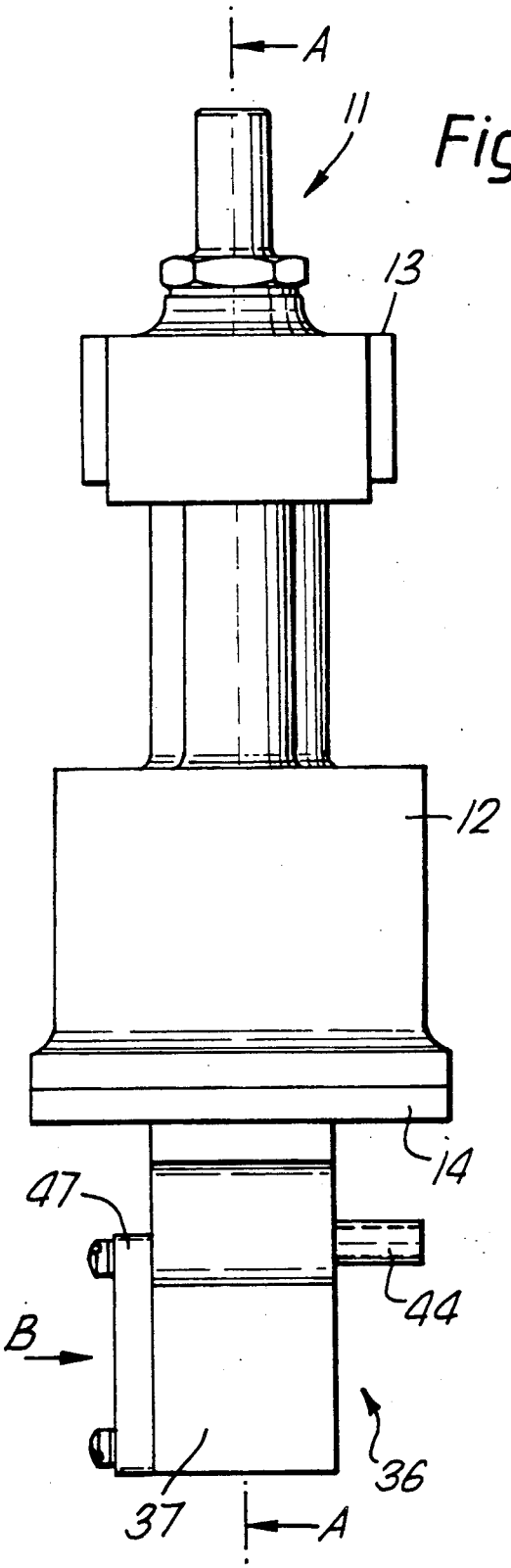
Fig. 1.
Fig. 3.
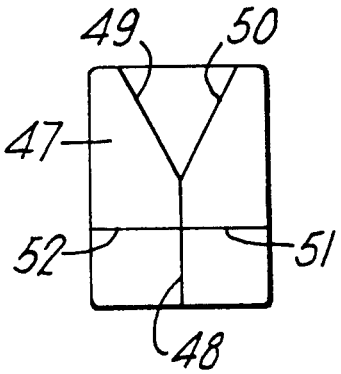

Pc
58
31
21
22
34
16
15
17
26
27
25
57
19
20
C
D
24
18
56
12
23
45
46
44
43
PD
39
40
41
38
53
54
50
49
47
52
51
48
55
Pc

FLUID COMPRESSORS

BACKGROUND OF THE INVENTION

1. Field of the Invention

This invention relates to fluid compressors and is particularly concerned with multiple stage fluid compressors.

2. Description of the Prior Art

Our co-pending U.S. patent application Ser. No. 430660 discloses several embodiments of a multiple stage fluid compressor in which each compression stage is driven by a pneumatically operated drive piston. Each drive piston is controlled by control means comprising at least one inlet valve and at least one outlet valve and drive and sequencing means comprising either individual phase controlled electric solenoids or a motor such as an electric motor driving sequencing means in the form of rotating or cam operated valves through a toothed timing belt.

Such devices therefore require a compressed air power supply and another, e.g. electric, power supply which complicates installation, and the use of valves and the solenoids or electric motor complicates the design and increases its bulk and consequently its weight.

SUMMARY OF THE INVENTION

An objective of this invention is to provide a two-stage fluid compressor which is less complex and easier to install than the prior compressors.

Accordingly, in one aspect, this invention provides a two stage fluid compressor comprising for each stage a compression piston operative in a compression cylinder and connected to a pneumatically operated single-acting drive piston operative in a drive cylinder, characterised by pneumatically operated drive means for alternately connecting a supply of pressurised drive air to the two drive cylinders and pneumatically operated control means for controlling the drive means.

Said drive means may comprise a relay valve having a double-acting piston operating a pivotable jet means for directing said pressurised drive air alternately to said drive cylinders.

Preferably, said control means may comprise a fluidic switching device which when used in an embodiment having a relay valve may include an inlet port for connection to a supply of pressurised control air, two outlet ports for connection to respective chambers at the ends of the double-acting piston and two switch ports for connection to switching air pressure supplies for alternately diverting said pressurised control air between the outlet ports.

Conveniently, said pressurised control air may be fed to two axially spaced-apart inlet ports opening into one of the compression cylinders, an annular recess on a piston rod interconnecting said drive and compression pistons arranged to provide selective fluid connection between one of said inlet ports and a first outlet port to provide said switching air pressure supply to one of said switch ports when the compression piston is at the end of its compression stroke and between the other said inlet port and a second outlet port to provide said switching air pressure supply to the other switch port when the compression piston is at the end of its return stroke.

In another aspect the invention provides a fluid compressor having first and second compression stages each comprising a compression piston operative in a compression cylinder, an inlet fluid connection to said first compression cylinder, a fluid passageway interconnecting the first and second compression cylinders and an outlet fluid connection from said second compression cylinder, and two drive pistons operative in drive cylinders and connected respectively to the compression pistons, characterised by a relay valve including connection means for connection during operation to a supply of pressurised drive air and having a double-acting piston operably connected to a pivotable jet means for directing during operation the pressurised drive air alternately to the drive cylinders, and a fluidic switching device for connection to a supply of pressurised control air and switching air pressure supplies adapted during operation to divert the pressurised control air supply alternately between chambers at the ends of the relay valve double acting piston.

BRIEF DESCRIPTION OF THE DRAWINGS

The invention will now be described by way of example only and with reference to the accompanying drawings in which, FIG. 1 is an end view of a two-stage compressor constructed in accordance with the invention, FIG. 3 is a schematic taken on arrow B of FIG. 1.

DETAILED DESCRIPTION OF THE DRAWINGS

Figure 2:
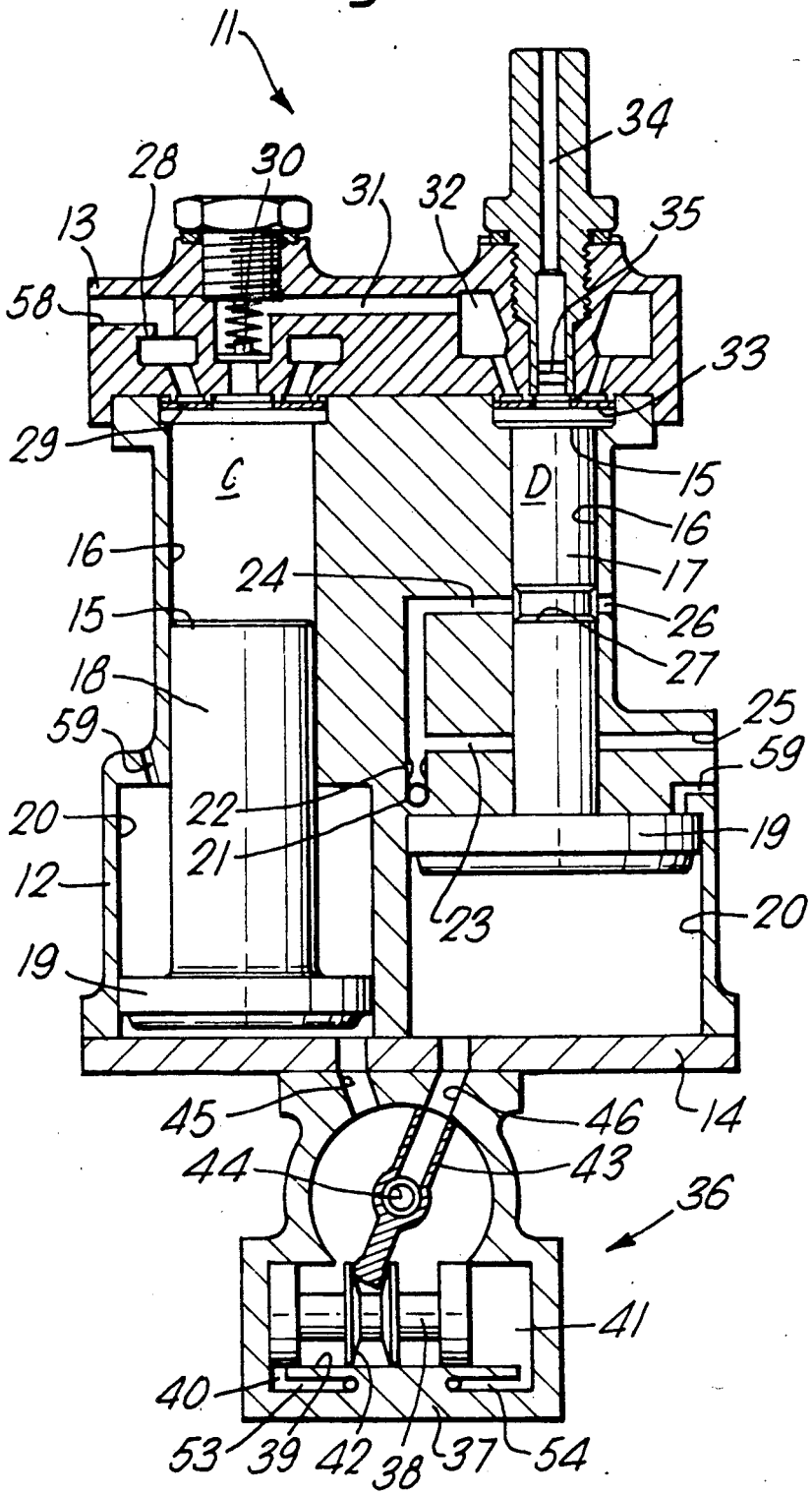
FIG. 2 is a sectioned view taken on lines A—A of FIG. 1.

A two-stage fluid compressor 11 comprises a cylinder block 12, an upper fluid distributor block 13 and a lower drive block 14.

The compressor 11 comprises a first compression stage C and a second compression stage D, each comprising a compression piston 15 operating in a compression cylinder 16. Piston 15 and therefore cylinder 16 of the second compression stage D are of smaller diameter than that of the first compression stage C.

The compression pistons 15 are connected by piston rods 17 and 18 to single-acting drive pistons 19 of similar diameter and located in drive cylinders 20. The drive cylinders 20 above the drive pistons 19 are vented to ambient through passages 59.

A connection 21 in the cylinder block 12 includes an orifice 22 and is connected through drilled passages to two axially spaced-apart inlet ports 23 and 24 opening into the compression cylinder 16 of the second compression stage D. Inlet port 23 is aligned with a first outlet port 25 and inlet port 24 is aligned with a second outlet port 26 in the cylinder block 12.

An annular recess 27 on the piston rod 17 of the second compression stage D is arranged so as to provide fluid communication between inlet port 23 and outlet port 25 when the compression piston 15 is at the end of its return stroke and between inlet port 24 and outlet port 26 when the compression piston 15 is at the end of its compression stroke as illustrated in FIG. 2.

Fluid distributor block 13 includes a fluid inlet connection 58, for connection to a supply of fluid to be compressed, leading to an annular fluid inlet chamber 28 connected via an annular inlet non-return valve 29 to the interior of the compression cylinder 16 of the first compression stage C. The compression cylinder 16 is connected through an outlet non-return valve 30 to a fluid passageway 31 which in turn is connected to the interior of an annular inlet chamber 32 of the second compression stage D. Chamber 32 is similarly connected through an annular inlet non-return valve 33 to the interior of compression cylinder 16 which in turn is connected to a compressed fluid outlet connection 34 through an outlet non-return valve 35.

Drive block 14 comprises an assembly of drive means and control means generally indicated at 36. The drive means comprises a relay valve 37 including a double-acting piston 38 operating in a cylinder 39 providing chambers 40, 41 at respective ends of the piston 38. A central annular groove 42 on the piston 38 locates one end of a pivotally mounted jet means 43 adapted during operation to direct a supply of pressurised drive air from an inlet 44 alternately through passages 45 and 46 to the interior of drive cylinders 20 below the respective drive pistons 19.

The control means includes a fluidic switching device 47 attached to drive block 14. The switching device is shown schematically in FIG. 3 as comprising an inlet connection 48, two outlet ports 49, 50 and two switching ports 51, 52.

Outlet port 49 is connected through passage 53 (FIG. 2) to the chamber 40 at one end of piston 38 and outlet port 50 is connected through passage 54 to chamber 41 at its other end.

Figure 4:
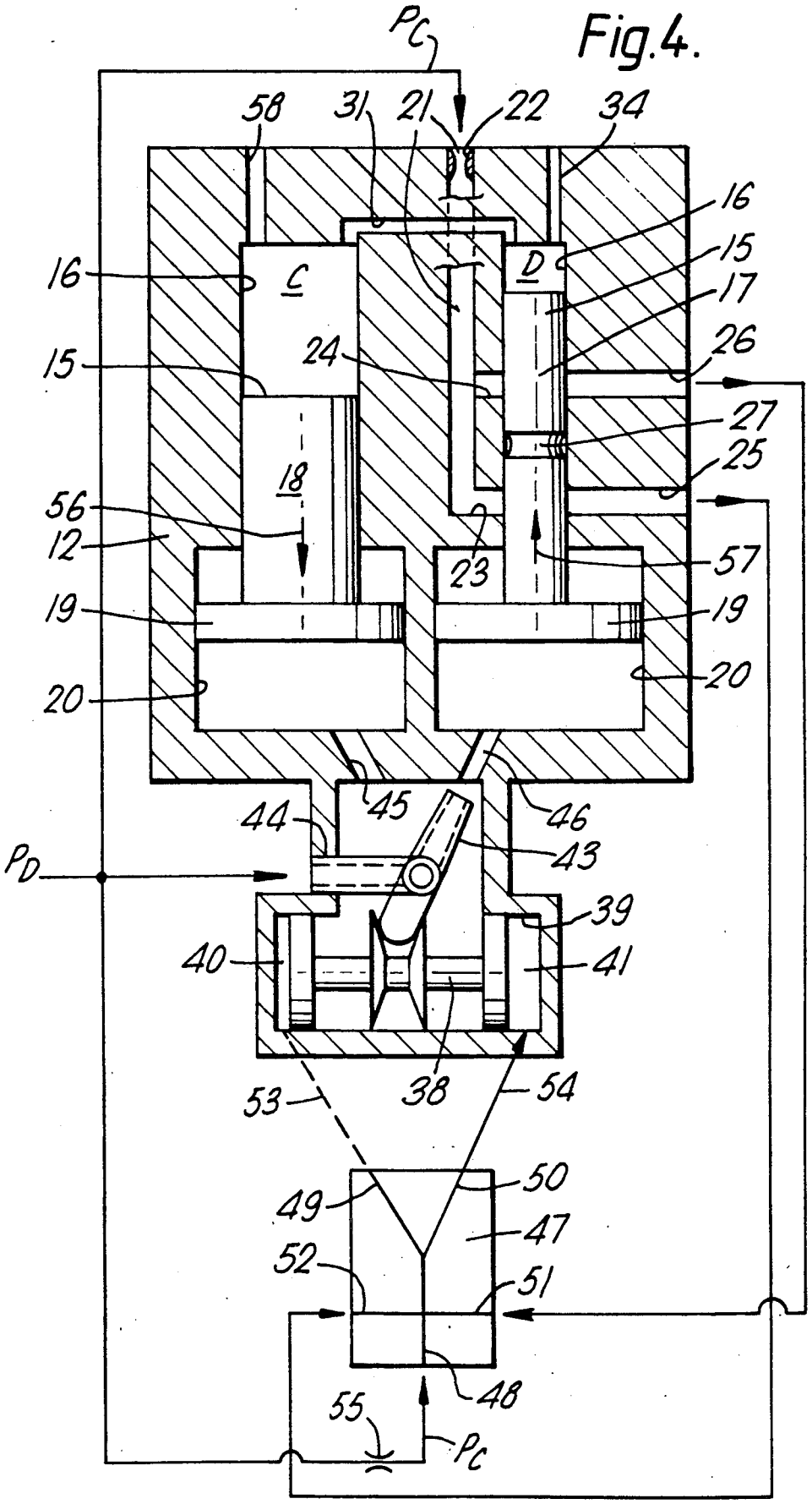
FIG. 4 is a schematic arrangement illustrating the operation of the compressor of the invention.

Operation of the compressor 11 will now be described with particular reference to FIG. 4. It will be understood that the compressor 11 is for use in an installation in which the fluid to be compressed enters the compression cylinder 16 of first compression stage C at a positive pressure sufficient to drive the respective drive piston 19 through its return stroke.

A supply of pressurised drive air ($P_D$)is connected to connection 44 associated with pivotable jet 43. A supply of pressurised control air ($P_C$) branched from the supply of drive air is connected via an orifice 55 to connection 48 of fluidic switching device 17 and to connection 21 on cylinder block 12. Orifices 22 and 55 reduce the pressure of the pressurised drive air ($P_D$) to a pressure suitable for the pressurised control air ($P_C$).

Drive piston 19 of first compression stage C is shown midway through its return stroke as indicated by arrow 56 under the influence of the pressurised fluid entering connection 58 and drive piston 19 of compression stage D is shown midway through its compression stroke as indicated by arrow 57, pressurised fluid exiting through compressed fluid outlet connection 34. Pressurised control air flowing through outlet port 50 into chamber 41 has moved the piston 38 so that jet 43 connects the pressurised drive air supply through passage 46 into drive cylinder 20 to move the drive piston 19 and attached compression piston 15 of compression stage D through its compression stroke.

It will be noted that, in the illustrated intermediate position, piston rod 17 effectively blocks fluid connection between inlet ports 23 and 24 and associated outlet ports 25 and 26. However as the compression piston 15 reaches the end of its compression stroke, the annular recess 27 on rod 17 connects inlet 24 to outlet 26 (as shown in FIG. 2) and a short duration switching pulse of pressurised control air is fed to switch connection 51 of fluidic switching device 47 to divert the supply of pressurised control air to exit from outlet port 49 and into chamber 40. This moves piston 38 to pivot the jet 43 to supply pressurised drive air through passage 45 into the drive cylinder 20 of compression stage C, compressed fluid passing through fluid passageway 31 and annular inlet chamber 32 into compression cylinder 16 of second compression stage D to move attached drive piston 19 through its return stroke.

The switching is reversed at the end of the return stroke of compression stage D when the annular recess 27 connects inlet 23 to outlet 25 to send a switching pulse of pressurised control air to switch port 52 of fluidic switching device 47.

Thus this invention provides a two-stage fluid compressor that is pneumatically driven and pneumatically controlled thereby dispensing with the individual control valves and the electric supplies and equipment required to control the operation of the aforementioned prior art compressors.

Whilst one embodiment has been described and illustrated it will be understood that many modifications may be made without departing from the scope of the invention as defined in the appended claims.

What is claimed is:

1. A fluid compressor having first and second compression stages each comprising a compression piston operative in a compression cylinder, an inlet fluid connection to said first compression cylinder, a fluid passageway interconnecting the first and second compression cylinders, an outlet fluid connection from said second compression cylinder, and two drive pistons operative in drive cylinders and connected respectively to the compression pistons, includes a relay valve having connecting means for connection during operation to a supply of pressurised drive air and double-acting piston operably connected to a pivotable jet means for directing during operation the pressurised drive air alternately to the drive cylinders, and a fluidic switching device for connection to a supply of pressurised control air and switching air pressure supplies arranged during operation to divert the pressurised control air supply alternately between chambers at the ends of the relay valve double-acting piston.

2. A two stage fluid compressor comprising for each stage a compression piston operative in a compression cylinder and connected to a pneumatically operated single-acting drive piston operative in a drive cylinder, pneumatically operative drive means comprising a relay valve having a double-acting piston operating a pivotable jet means for directing a supply of pressurised drive air alternately to said drive cylinders and pneumatically operated control means controlling the drive means.

3. A compressor as claimed in claim 2, wherein said control means comprise a fluidic switching device.

4. A two stage fluid compressor comprising for each stage a compression piston operative in a compression cylinder and connected to a pneumatically operated single-acting drive piston operative in a drive cylinder, pneumatically operative drive means comprising a relay valve having a double-acting piston operating a pivotable jet means for directing a supply of pressurised drive air alternately to said drive cylinders and pneumatically operated control means controlling the drive means and comprising a fluidic switching device having an inlet port for connection to a supply of pressurised control air, two outlet ports for connection to respective chambers at the ends of the double-acting piston and two switch ports for connection to switching air pressure supplies for alternately diverting the pressurised control air between the outlet ports.

5. A compressor as claimed in claim 4, wherein said pressurised control air is fed to two axially spaced-apart inlet ports opening into one of the compression cylinders, an annular recess on a piston rod interconnecting said drive and compression pistons arranged to provide selective fluid connection between one of said inlet ports and a first outlet port to provide said switching air pressure supply to one of said switch ports when the compression piston is at the end of a compression stroke and between the other said inlet port and a second outlet port to provide said switching air pressure supply to the other switch port when the compression piston is at the end of a return stroke.

* * * * *